United States Patent [19]

Eichinger

[11] Patent Number: 4,697,527

[45] Date of Patent: Oct. 6, 1987

[54] DRIVE UNIT FOR A RAIL VEHICLE

[75] Inventor: Johann Eichinger, Veterstetten, Fed. Rep. of Germany

[73] Assignee: Carl Hurth Maschinen- und Zahnradfabrik GmbH & Co., Munich, Fed. Rep. of Germany

[21] Appl. No.: 910,316

[22] Filed: Sep. 22, 1986

Related U.S. Application Data

[63] Continuation of Ser. No. 659,376, Oct. 10, 1984, abandoned.

[30] Foreign Application Priority Data

Oct. 17, 1983 [DE] Fed. Rep. of Germany ..... 3337695
Apr. 21, 1984 [DE] Fed. Rep. of Germany ..... 8412522

[51] Int. Cl.[4] ..... B61C 17/00

[52] U.S. Cl. ..... 105/133; 105/131; 105/132

[58] Field of Search ..... 105/133, 138, 139, 140, 105/136, 131, 132

[56] References Cited

U.S. PATENT DOCUMENTS

| | | | |
|---|---|---|---|
| Re. 30,381 | 8/1980 | Ries | 105/131 |
| 451,981 | 5/1891 | Short | 105/139 X |
| 567,560 | 9/1896 | Bagnall | 105/139 X |
| 1,810,834 | 6/1931 | Klein | 105/138 X |
| 3,859,929 | 1/1975 | Korn et al. | 105/136 X |
| 4,170,945 | 10/1979 | Kayserling | 105/136 X |
| 4,278,028 | 7/1981 | Eichinger et al. | 105/140 X |
| 4,444,120 | 4/1984 | Bille | 105/136 X |

FOREIGN PATENT DOCUMENTS

| | | | |
|---|---|---|---|
| 603696 | 7/1933 | Fed. Rep. of Germany | 105/133 |
| 2106662 | 8/1972 | Fed. Rep. of Germany | 105/131 |
| 2853839 | 6/1980 | Fed. Rep. of Germany . | |
| 803883 | 11/1958 | United Kingdom | 105/136 |

*Primary Examiner*—Robert B. Reeves
*Assistant Examiner*—Glenn B. Foster
*Attorney, Agent, or Firm*—Flynn, Thiel, Boutell & Tanis

[57] ABSTRACT

A drive unit for a rail vehicle has a motor-gearing unit which is supported on at least one wheel-set axle of a bogie and which includes either a motor which extends in the longitudinal direction of the vehicle and has miter gearing units connected to both ends of a motor which extends parallel to the wheel-set axle and has a spur gearing unit coupled with its drive shaft. Each miter gearing unit or the spur gearing has as its output a hollow shaft which concentrically surrounds the respective wheel-set axle. The hollow shaft is connected to the associated wheel-set axle by an elastic coupling which permits axle dislocations and shaft-angle deviations, and also by an elastic bearing which transmits the weight of the motor-gearing unit to the axle. The elastic bearing can be provided laterally of the gearing unit on the hollow shaft, or can be provided within the hollow shaft. For countering tilting moment and mass-acceleration forces, at least one lever is provided as a support member and is elastically hinged to the motor and to the vehicle frame or the bogie.

20 Claims, 10 Drawing Figures

Fig. 8
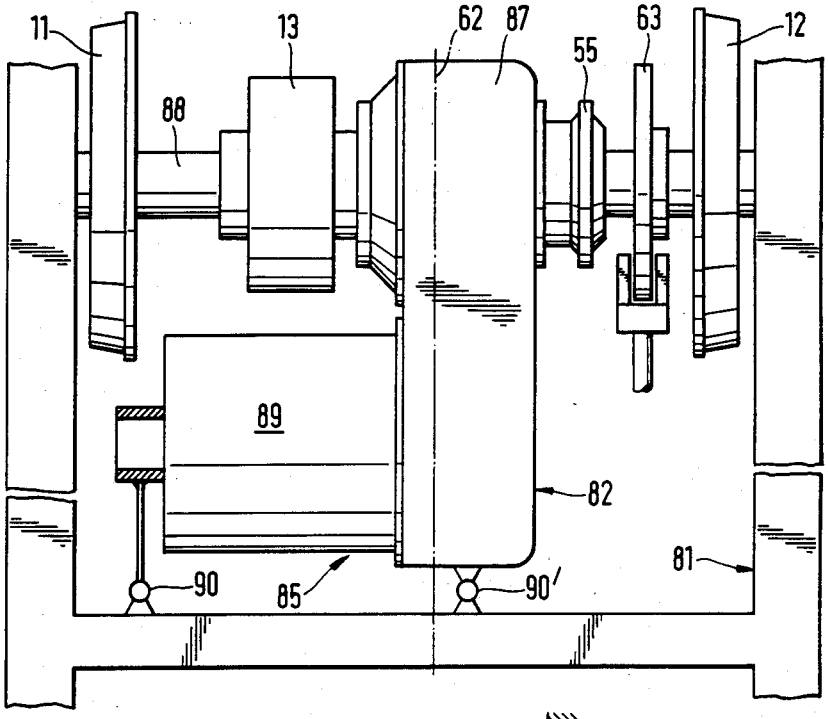
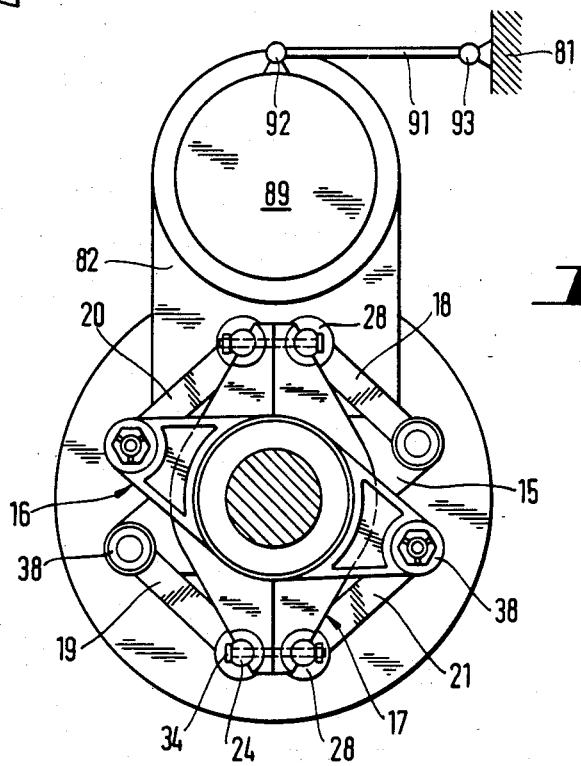
Fig. 10

DRIVE UNIT FOR A RAIL VEHICLE

This application is a continuation of Ser. No. 659,376 filed Oct. 10, 1984 now abandoned.

FIELD OF THE INVENTION

The invention relates to a drive unit for a rail vehicle and, more particularly, to a drive unit which includes a motor-gearing unit supported on a wheel-set axle, the motor-gearing unit having a drive motor and a gearing unit coupled to and operatively driven by the motor, the gearing unit having as an output a hollow shaft which substantially concentrically surrounds the wheel-set axle and is coupled thereto by an elastic coupling such as a cardan joint.

BACKGROUND OF THE INVENTION

Drive units of the foregoing type have been known for quite some time. They are double-axle drives which are also indentified as floating drives. German Patent No. 838 452 has as its subject matter a drive of the described type, in which the elastic coupling is formed by a rubber disk which surrounds the wheel-set axle and which is connected on one side, for example by vulcanizing, to a disk-shaped flange which is secured on the hollow shaft and is connected on its other side to a disk-shaped flange which is mounted on the wheel-set axle. (Where reference is made herein to rubber, then plastics and similar materials which have characteristics comparable to rubber are also included.) Due to the weight of the drive unit and the mass forces which occur during operation, the rubber disks are mainly stressed for thrust, namely in a plane which lies perpendicular to the wheel-set axle. In order to thereby not permit the drive unit to sag too much with respect to the wheel-set axle, the rubber disks must be relatively narrow and hard. With this, however, the negative effects of the tangential stress are increased and the spring action in a transverse direction, namely in the direction of the wheel-set axle, is further degraded. A further very important disadvantage is that, during replacement of the rubber disks when replacement becomes necessary, the wheels must be pulled off the axles.

This operationally disturbing disadvantage is avoided in a coupling with split rubber elements, as is known for example from German Offenlegungsschrift No. 23 32 281. A hub which is mounted on the hollow shaft and a hub which is mounted on the wheel-set axle each have a number of arms which extend radially outwardly and are arranged alternately, one after the other. A rubber block is inserted between each pair of arms. The rubber blocks can each be removed radially outwardly and can be installed from the outside without pulling the wheels off the axles, but special devices are needed for installing and removing rubber blocks. This type of coupling is very stiff in the plane which is perpendicular to the wheel-set axle. It is softer in a transverse direction than the design with the rubber disks, but the rubber blocks are exposed to a tangential stress. A further disadvantage is the fact that the rubber blocks receive their initial tension only during installation, which also makes installing and removing them difficult.

Also, a coupling has been suggested for those cases of use (German Offenlegungsschrift No. 28 53 839) in which two coupling halves, one of which is mounted on the hollow shaft of the gearing and the other on the wheel-set axle, are both constructed substantially as rotation-symmetric members, and are connected with one another by radially arranged rubber-joint sleeves. In this design, even though the installing and removing of the rubber-joint sleeves can be carried out easily, their dimensioning does pose some problems in order to be able to fulfill as completely as possible all requirements.

In all mentioned existing designs, the elastic couplings between the hollow shafts and the wheel-set axles have the task to support the motor-gearing unit on the wheel-set axle and to also transmit the driving torque onto the wheel-set axle. The restoring forces which, during an angular deflection of the wheel-set axle, act from the elastic coupling onto the wheel-set axle are thereby supposed to be as small as possible. The reason for this is that, during travelling over unevennesses (for example switches and crossings) or obstacles (for example small articles lying on the rails) which cause one of the four wheels to drop down one-sidedly or to be lifted up, an unfavorable influence on the wheel forces is avoided as much as possible and in this manner the safety against derailing is not influenced.

A drive unit of the general type to which the invention relates is known from German Auslegeschrift No. 24 34 420. In this arrangement of the motor-gearing unit in the vehicle or bogie frame, the elastic coupling transmits between the gearing unit hollow shaft and the wheel-set axle only torques, but the motor-gearing unit is, in spite of the use of elastic bearing sleeves, relatively rigid. If one desires to arrange the motor-gearing unit so as to be substantially cushioned, then solutions are available as used in the aforedescribed double longitudinal drives. In the known designs, one tries to do justice as much as possible to the set demands through a specific construction of the couplings and the elastic elements contained therein. This, however, is only possible in the form of compromises. The demand for high stiffness in a radial direction and in a peripheral direction (with reference to the wheel-set axle), and for a very small stiffness during an angular deflection of the wheel-set axle relative to the hollow shaft, have so far been met only incompletely. In the design according to German Offenlegungsschrift No. 23 32 281, for example, the relationship to each other of the stiffnesses which act in various directions and the stress of the elastic elements was improved over the design according to German Patent No. 838 452. However, the disadvantageous dependency of these values from one another remains, so that only a compromise is possible. For example, during an angular deflection of the wheel-set axle in a vertical plane, the elastic elements which just then lie in the horizontal plane are stressed for pressure and are thus relatively stiff. If one would make the elastic elements softer in this pressure direction in order to achieve a more favorable characteristic line, then automatically "softer" characteristic lines in a radial direction and in a peripheral direction would also result, which is contrary to the initially mentioned demands. Furthermore, a higher stress of the elastic elements would also result.

To do away with the mentioned disadvantages in order to indeed fulfill the mentioned demands in a basic purpose of the present invention.

SUMMARY OF THE INVENTION

This purpose is attained in a highly satisfactory manner for a double-axle drive unit of the type to which the invention relates by providing, in addition to the elastic coupling which each hollow shaft to its wheel-set axle, an elastic coupling or bearing on each wheel-set axle which transmits the weight of the motor-gearing unit to that axle, and by providing at least one support member between the motor-gearing unit and bogie frame which acts substantially in a horizontal direction.

The two "couplings" which are associated with a hollow shaft or a wheel-set axle now take on different functions and are thus differently designed. One "coupling" includes an elastic ring which only transmits the weight of the motor-gearing unit onto the wheel-set axle and does not participate in the transmission of the driving torque thereto. This elastic element is identified herein as an elastic bearing, since it does not have any coupling function. The other coupling is a known elastic coupling, which only transmits the torque from the hollow shaft onto the wheel-set axle. Compared with the known designs with four couplings, the two couplings according to the inventive arrangement may possibly have to be slightly reinforced, which does not create any problems with respect to space. This type of construction permits radial, axial and angular movements of the wheel-set axle relative to the hollow shaft, and produces thereby only very small restoring forces.

The inventive purpose is attained for a single axle drive unit of the type to which the invention relates by providing in addition to the elastic coupling which couples the hollow shaft and wheel-set axle, an elastic bearing which transmits the weight of the motor-gearing unit to the wheel-set axle, and by providing at least two support members which extend between the motor gearing unit and the vehicle frame.

For the design and arrangement of the elastic bearing, various advantageous embodiments are disclosed herein. The arrangement of the elastic bearing next to the hollow shaft has the advantages of easy accessibility and simple exchangeability of the rubber ring or rings. The wheel-set axle or other large structural parts need not be removed for this. During the initial assembly, a rubber ring which is closed can be used for the elastic bearing and, during a replacement within the completed bogie, the ring can be split. If the elastic bearing is arranged within the hollow shaft, then the accessibility and exchangeability is influenced, but the entire space between the gearing unit and the wheel which is provided on the side of the gearing unit opposite the elastic coupling is available for providing a brake mechanism, for example a disk brake. This is particularly advantageous in the case of a narrow-gauge vehicle.

The double-axle drive is preferably designed so that the center of gravity of the motor-gearing unit lies on an imaginary connecting line extending between the two elastic bearings. This is achieved the easiest by the two gearing units being designed alike. Mass-acceleration forces and tilting moments about the connecting line, which are created for example by the center of gravity of the motor not lying centrally and thus the center of gravity of the unit being spaced slightly from the connecting line, are countered by the support member. This support member, which acts substantially in a horizontal direction, is preferably perpendicular to the connecting line. Such an arrangement of the support member permits, without and disadvantageous influence, all relative moment between the bogie and the motor-gearing unit which can be caused by the resilient support of the axle.

For a single axle drive in which the motor, viewed in the direction of travel, is arranged axially parallel to and in front of or behind the wheel-set axle, known suspensions can be provided as support members. However, for applications where the motor is arranged above the wheel-set axle, the support members are preferably substantially horizontally arranged steering levers which have their ends pivotally coupled to the motor-gearing unit and the vehicle frame. Such an arrangement of the support member permits, without any disadvantageous influence, all relative operational movement between the bogie and the motor-gearing unit, including movement caused by the resilient support of the axle.

BRIEF DESCRIPTION OF THE DRAWINGS

The invention will be described hereinafter in connection with several exemplary embodiments which are illustrated in the figures.

In the drawings:

FIG. 8 is a diagrammatic top view similar to FIG. 1 showing a further alternative embodiment of the drive unit of FIG. 1, including a motor-gearing unit with a motor which lies next to the wheel-set axle;

FIG. 10 is a side view of an alternative embodiment of the drive unit of FiG. 8 in which the motor is disposed above the wheel-set axle.

DETAILED DESCRIPTION

Figure 1:
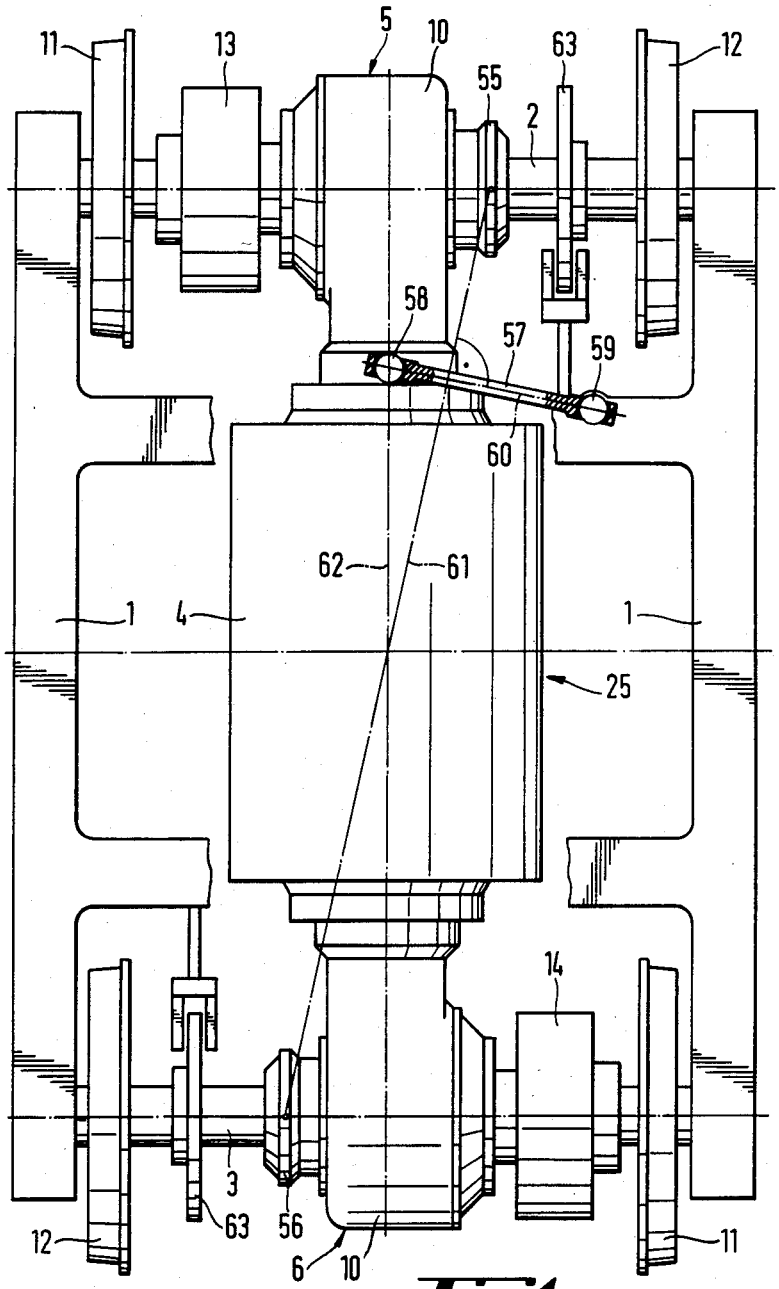
FIG. 1 is a diagrammatic top view of a two-axle drive unit for a rail vehicle which embodies the present invention, showing an arrangement of a motor-gearing unit in a two-axle bogie.

In the frame of a bogie which is indicated generally at 1 (FIG. 1), there are supported two wheel-set axles 2, 3. A conventional drive motor 4 is arranged between the wheel-set axles, on the two ends of which motor there are connected respective bevel or miter gear units 5, 6. The motor-gearing unit which includes the motor and the two gearing units 5, 6 is identified with reference numeral 25. Power transmission from the not illustrated shaft of the motor occurs through conventional and not illustrated tooth couplings to the pinion shafts 7 (FIG. 2) of the two miter gear units, and from there onto ring gears 8 (FIG. 2). Each ring gear 8 is mounted on and fixed against rotation with respect to a hollow shaft 9 by screws and pins connecting it to a flange-like annular enlargement of the hollow shaft 9. The hollow shaft 9 is, like the pinion shaft 7, supported rotatably by roller bearings, is supported so as to be axially nonmovable in the housing 10 of the respective gearing unit 5 or 6, and projects outwardly on both sides of the housing 10. The wheel-set axles 2 and 3, on which driving wheels 11 and 12 are mounted so as to be fixed against rotation, extend approximately coaxilly through the hollow shaft 9 with a radial spacing which is needed for the springy movement.

Figure 2:
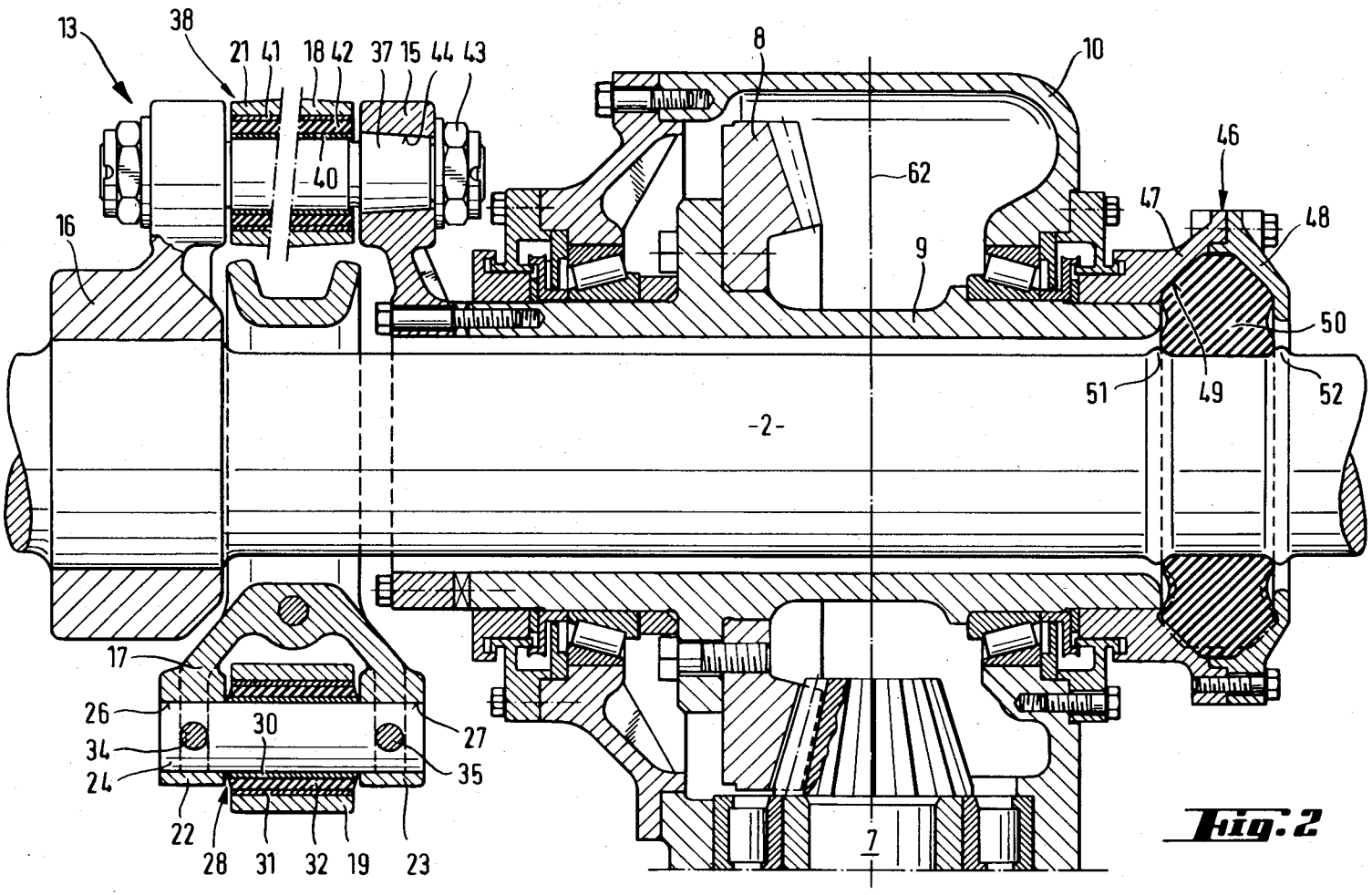
FIG. 2 is a fragmentary sectional top view of a gearing unit and a laterally adjacent elastic bearing which are components of the drive unit in FIG. 1.
Figure 3:
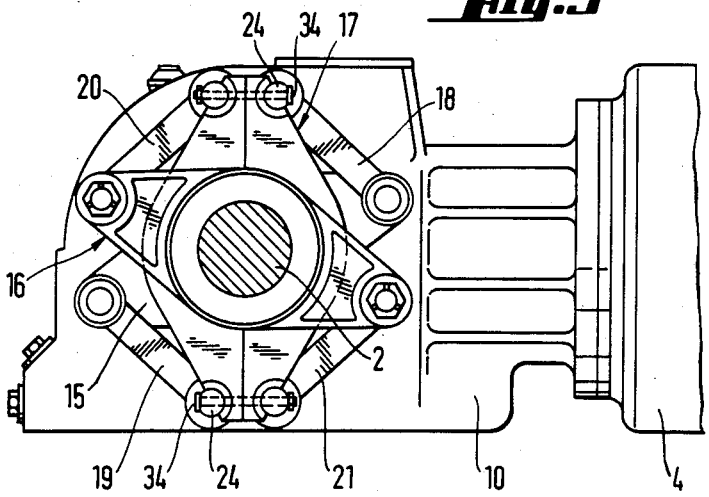
FIG. 3 is a side view of the elastic coupling of FIG. 1.

The resilient driving connection from each hollow shaft 9 to be associated wheel-set axle 2 or 3 occurs through a respective joint coupling 13 or 14 (FIG. 1). Each coupling includes a first flange 15 (FIGS. 2 and 3) fixedly connected to the hollow shaft 9 and a second flange 16 fixedly connected to the wheel-set axle, and a floating intermediate member 17 is provided therebetween. The first flange 15 and the intermediate member 17 are each pivotally connected to two steering or guide levers 18 and 19, and the second flange 16 and the intermediate member 17 are each pivotally connected to two steering or guide levers 20 and 21. Thus, a four-bar-chain is formed by the first flange 15, the steering levers 18 and 19 and the intermediate member 17, and a further four-bar-chain is formed by the intermediate member 17, the steering levers 20 and 21 and the second flange 16. Since the intermediate member 17 which connects the two four-bar-chains is a floating member, the coupling can balance out relative radial movements between the cushioned parts (4, 5, 6, 15) and the noncushioned parts (2, 3, 11, 12, 16).

The intermediate member 17 is provided with two forks for receiving the ends of the steering levers. The prongs of one such fork are identified in FIG. 2 with reference numerals 22, 23. The prongs end in approximately semicylindrical recesses 26, 27 which receive pins 24 belonging to rubber joints 28 of the steering levers, which rubber joints are on the intermediate-member side. Each rubber joint 28 includes an inner part 30 and an outer part 31 which are cylindrical sleeves. Between the inner and the outer parts there is, under an initial tension, an elastic member 32 which is connected to the inner part 30 and to the outer part 31, for example by vulcanizing. The pins 24 are connected by screws 34 and 35 and associated nuts to the intermediate member 17 so that they can be removed axially from the recesses 26 and 27 after removing the screws and nuts.

The steering levers 18, 19, 20, 21 are connected by rubber joints 38 (FIG. 2) to the first flange 15 and the second flange 16. Each rubber joint 38 includes an inner part 40 and an outer part 41 which are cylindrical sleeves. An elastic member 42 is provided therebetween under an initial tension and is connected to both the inner part 40 and the outer part 41, for example by vulcanization. The inner parts 40 are supported on pins 37, which with a conical end 44 project into a conical bore in the associated flange and are tightened with a nut 43. After releasing of the nuts, the pins 37 can be removed axially out of the respective flange. The design of the rubber joints 28 and 38 is not limited to the illustrated embodiments, but other forms are also possible.

On the side of each gearing unit 5, 6 remote from the joint couplings, one half 47 of a bearing housing 46 is supported on the hollow shaft 9 so as to be fixed against rotation relative thereto, for example by a shrink fit. A housing half 48 is screwed to the housing half 47. The two halves enclose an annular chamber 49 which is provided adjacent the hollow shaft 9 and which is defined at its radially inner end by the wheel-set axle 2 or 3. A ring 50 of rubber or another elastic material is provided in the annular chamber 49. The rubber ring 50 is, prior to assembly, wider and/or higher than the annular chamber 49. During screwing together of the two bearing-housing halves 47 and 48, the ring 50 is compressed in an axial and/or a radial direction so as to be initially tensioned between the halves 47 and 48 and the wheel-set axle 2 or 3, and so as to at least approximately fill the entire annular chamber 49. The rubber ring 50, together with the bearing housing 46, forms an elastic bearing. The rubber ring 50 is thereby held between two annular ribs or bulges 51, 52 on the wheel-set axle.

Figure 4:
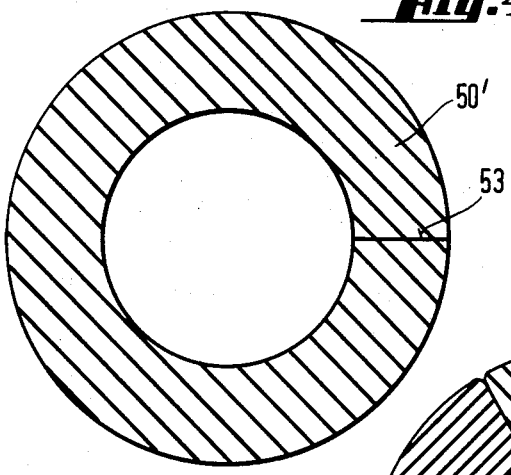
FIG. 4 is a sectional side view of the elastic bearing in FIG. 2.
Figure 5:
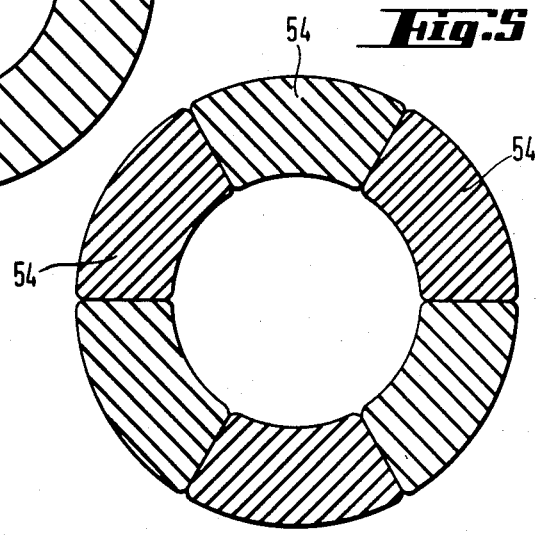
FIG. 5 is a view similar to FIG. 4 showing a different embodiment of the elastic bearing of FIG. 2.

During the original assembly of the bogie, and in particular the motor-gearing unit 25 and the wheel-set axles 2 and 3, the rubber ring 50 may be a closed ring. When this ring subsequently is to be replaced, it is possible, in order to avoid demounting the bogie, to substitute an arcuate, split rubber ring 50'. The separating line 53 is indicated in FIG. 4. However, it is also possible to use, in place of the closed ring 50 or arcuate split ring 50', two or more separate, segmentlike rubber parts which together define a ring. In the example which is illustrated in FIG. 5, there are six segments 54. The cross section of the rubber ring 50 or 50' or the segments 54 is not limited to the illustrated form. Other forms are also possible, and two or more rubber rings or segments arranged side-by-side or within one another can be used. The elastic bearings are, like the couplings 13 and 14, practically service-free. Furthermore, they are easily accessible, and the rubber rings 50 and 50' or the segments 54 can, if necessary, be easily replaced within the bogie.

In FIG. 1, the two elastic bearings of the miter gear units 5 and 6 are respectively identified with reference numerals 55 and 56. The motor-gearing unit 25 is supported by these bearings 55 and 56 on the wheel-set axles 2 and 3. For countering mass-acceleration forces and torques or tilting moments, a steering or guide lever 57 is provided as a support member and is pivotally connected at its ends to the motor 4 and to the bogie frame 1. The pivot points are identified with reference numerals 58 and 59 in FIG. 1. The function of the steering lever 57 is most effective if, in relationship to the bogie, it is arranged in an at least approximately horizontal position along a line 60 which extends at a right angle with respect to an imaginary connecting line 61 between the centers of the two elastic bearings 55 and 56. The steering lever 57 is supported elastically at the two hinge points 58 and 59 by spherical bearings.

A brake disk 63 is also arranged on each of the wheel-set axles 2 and 3 between the elastic bearing 55 or 56 and the adjacent driving wheel 12. In special cases, for example in the case of narrow-gauge vehicles or in the case of an inside support of the wheel-set axles 2 and 3 in the bogie frame 1, if there would otherwise not be sufficient space for the braking mechanism, then the elastic bearing can be provided within the hollow shaft 9, so that it does not require any additional space next to the gearing unit housing 10. This arrangement can also be chosen when the "axis of tilt" of the motor-gearing unit 25, which corresponds with the connecting line 61, is not supposed to be inclined with respect to or is supposed to be less inclined with respect to the direction of travel than is illustrated in FIG. 1.

Figure 6:
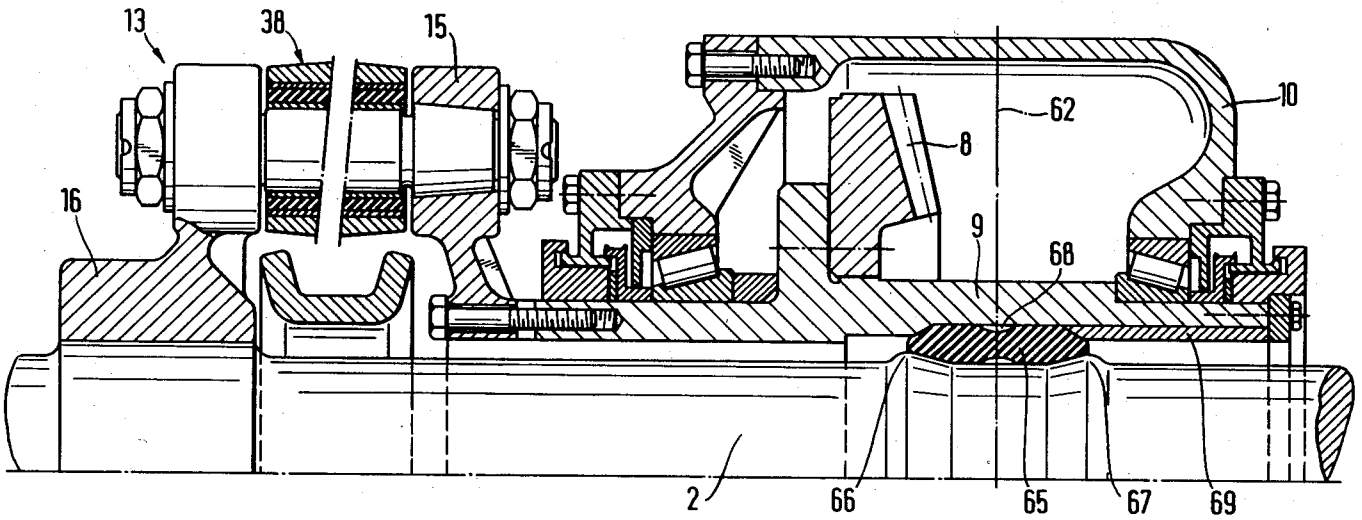
FIG. 6 is a fragmentary sectional top view of an alternative embodiment of the drive unit of FIG. 1 in which the gearing unit has a centrally arranged elastic bearing.
Figure 7:
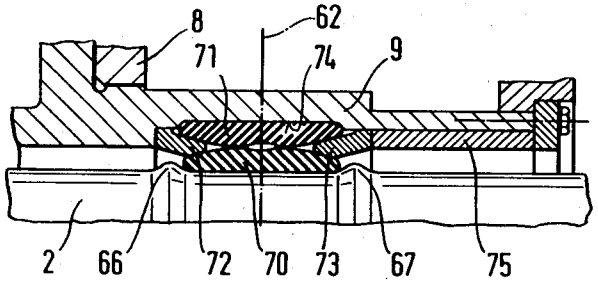
FIG. 7 is a view similar to a portion of FIG. 6 and shows a different embodiment of the centrally arranged elastic bearing.

The exemplary embodiment which is illustrated in FIG. 6 has an elastic bearing positioned so that the connecting line between the elastic bearings corresponds with the vehicle longitudinal axis 62 of the motor-gearing unit 25. In particular, a rubber ring 65 is placed between two bulges 66 and 67 on the wheel-set axle 2 or 3 and is in a recess 68 in the hollow shaft 9, and the rubber ring 65 is initially tensioned by means of a sleeve 69 which is introduced coaxially into the hollow shaft 9. The cross section of the rubber ring 65 is not limited to the illustrated shape; other shapes are also possible, or two rubber rings 70 and 71 can be used (FIG. 7). The rubber ring 70 lies axially between the bulges 66 and 67 and between two frustoconical rings 72 and 73, and is encircled by the rubber ring 71. The rubber rings 70 and 71 are initially tensioned by the frustoconical rings 72 and 73, which are urged toward each other by means of a sleeve 75 which is introduced coaxially into the hollow shaft 9. For both embodiments, it is possible to name as advantages the uncomplicated mounting of simply shaped rubber parts, and that axial forces can be transmitted in a positive manner. A certain disadvantage can be seen in the fact that the elastic bearings can be disassembled only with difficulty or not at all within the bogie.

Figure 9:
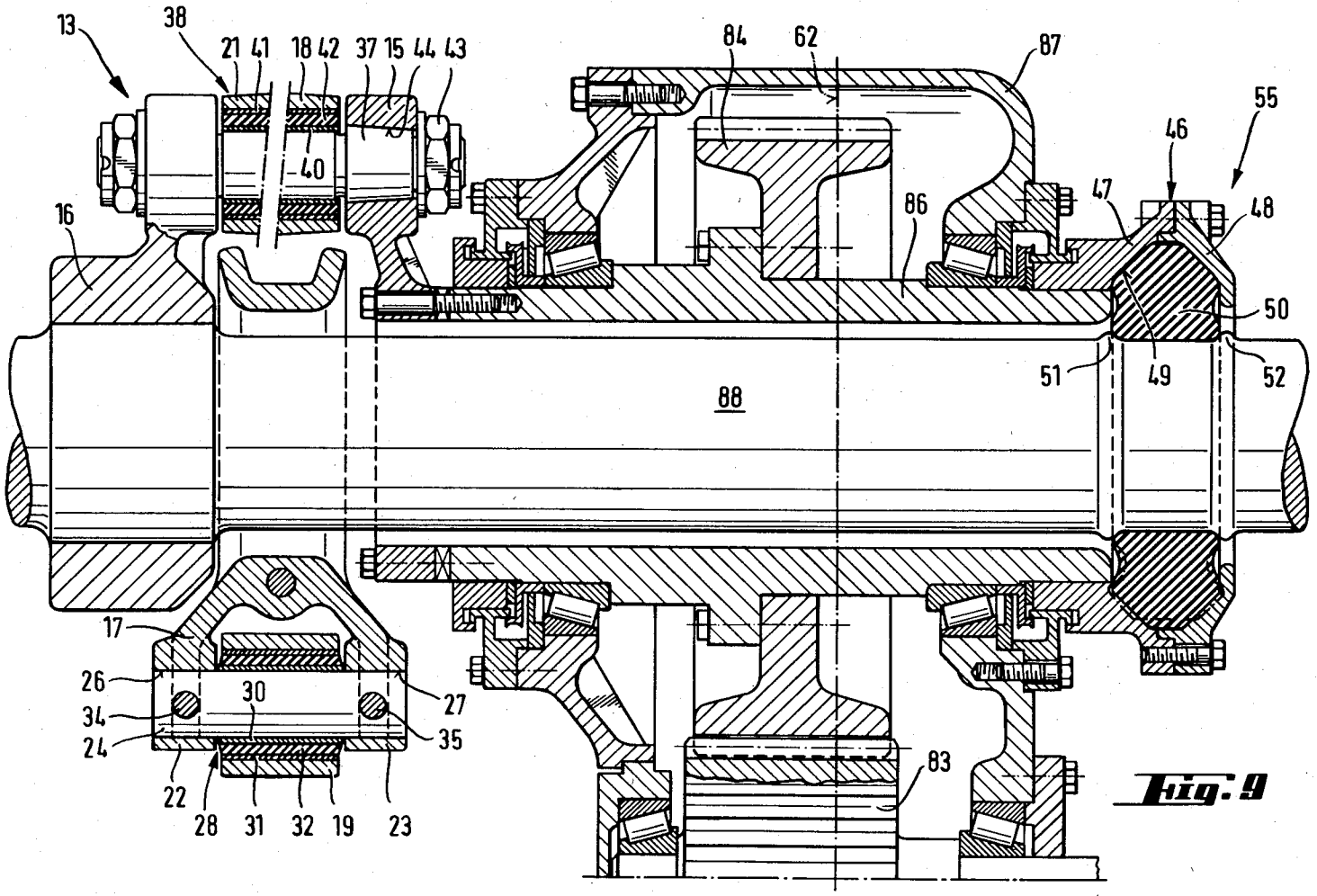
FIG. 9 is a fragmentary sectional top view of a gearing unit and laterally adjacent elastic bearing which are components of the drive unit of FIG. 8.

A wheel-set axle 88 is supported in FIG. 8, as an example of a single axle drive, in the frame 81 of a rail vehicle. A drive motor 89 is arranged above the wheel-set axle, and to one side of the drive motor 89 is connected a spur gearing unit 82. The motor-gearing unit which includes the motor 89 and the gearing unit 82 is identified with reference numeral 85. Power transmission from the not illustrated motor shaft is effected through conventional and not illustrated tooth couplings to the pinion 83 (FIG. 9) of the spur gearing and from there to the gear 84. This gear 84 is mounted by screws and/or pins on an annular flange-shaped enlargement of a hollow shaft 86 so as to be fixed against rotation relative to the hollow shaft 86. The hollow shaft 86 is, like the pinion 83, supported rotatably by roller bearings, is supported so as to be axially nonmovable in the housing 87 of the gearing unit 82, and projects at both ends from the housing 87. The wheel-set axle 88 extends approximately coaxially through the hollow shaft 86 with a radial clearance which is needed for springy movement, and driving wheels 11, 12 are mounted on the wheel-set axle 88 so as to be fixed against rotation.

The driving connection from the hollow shaft 86 to the wheel-set axle 88 occurs through a joint coupling 13 (FIG. 9) in the same manner as in the above-described embodiments. The cushioned parts now include those identified by reference numerals 89, 82, 15 and the non-cushioned parts include those identified by reference numerals 88, 11, 12, 16. The design of the joint coupling 13 and thé elastic bearing 55 corresponds with that of FIGS. 2, 4 and 5. The motor-gearing unit 85 is supported on the wheel-set axle 88 by the elastic bearing 55. It can be advantageous, but is not absolutely necessary, for the center of the bearing 55 to lie at least approximately at the longitudinal axis 62 of the vehicle, but this can be realized only in few cases. To support mass-accelaration forces and torques of tilting moments, two support members 90 and 90' are provided which pivotally couple the motor 89 and/or the gearing housing 87 to the vehicle frame 81.

When, as is illustrated in FIG. 10, the motor 89 is arranged above the wheel-set axle 88, then two steering levers are used as support member of which one is visible in FIG. 10 and is identified with reference numeral 91. Their hinge points are identified with reference numerals 92 and 93. The steering levers 91 function most effectively if, in relationship to the rail vehicle and as illustrated in FIG. 10, they are arranged at least approximately horizontally. The steering levers 91 are supported elastically in spherical bearings at their two hinge points 92 and 93.

The arrangement of brake disk 63 is the same as for the embodiments described above, and a possible alternative arrangement of the elastic bearing so as to be within the hollow shaft 86 can be effected in a manner similar to that described above in connection with FIGS. 6 and 7.

It is expressly pointed out that the invention is not limited to the described and illustrated embodiment of the gearing and the elastic coupling. Other gearings, for example those with a further gearing step, are possible and it is easily possible to choose a different construction for the elastic coupling. Other variations or modifications of the disclosed appartaus, including the rearrangement of parts, also lie within the scope of the invention.

The embodiments of the invention in which an exclusive property or privilege is claimed are defined as follows:

1. In a drive unit mounted on a frame of a rail vehicle having at least one wheel-set axle, said drive unit including a motor-gearing unit supported on said at least one wheel-set axle, said motor-gearing unit having a drive motor with an output shaft and at least one gear unit with an input shaft which is coupled with said output shaft of said drive motor, said gear unit having an output shaft in the form of a hollow drive shaft which substantially concentrically surrounds said wheel-set axle, and elastic torque transmitting coupling means for coupling said hollow drive shaft to said wheel-set axle, the improvement comprising wherein elastic bearing means separate from said elastic torque transmitting coupling means are provided between said hollow drive shaft and said wheel-set axle for transmitting a weight force of said motor-gearing unit to said wheel-set axle while simultaneously facilitating a relative inclination between an axis of said wheel-set axle and an axis of said hollow drive shaft, said elastic bearing means being spaced along the length of said wheel-set axle from said elastic torque transmitting coupling means, and wherein guide lever means are provided between said frame and said motor-gearing unit for providing further support for said motor-gearing unit in a substantially horizontal direction laterally of the longitudinal axis of said rail vehicle to counter massacceleration forces, torque and tilting moments acting on said motor-gearing unit and thereby restrict the application of force, other than said weight force, on said elastic bearing means.

2. The drive unit according to claim 1, wherein two wheel-set axles are provided;

wherein said gear unit includes a bevel gear connection between said hollow drive shaft and said output shaft of said drive motor;

wherein said output shaft and said drive motor extends longitudinally of said rail vehicle; and wherein said frame is a frame of a bogie.

3. The drive unit according to claim 2, wherein said elastic bearing means is arranged on a side of said hollow drive shaft which is remote from said elastic coupling means.

4. The drive unit according to claim 2, wherein said elastic bearing means is arranged inside of said hollow shaft drive shaft.

5. The drive unit according to claim 2, wherein said elastic bearing means is arranged symmetrically with respect to the longitudinal axis of the vehicle and an axis thereof is inside said hollow drive shaft.

6. The drive unit according to claim 2, wherein said guide lever means is a substantially horizontal extending steering lever having one end thereof pivotally coupled to said motor-gearing unit and an other end thereof pivotally coupled to said frame.

7. The drive unit according to claim 2, wherein the line of action of said guide lever means is directed substantially at a right angle with respect to and imaginary connecting line between the two elastic bearing means.

8. The drive unit according to claim 2, wherein said elastic bearing means includes at least one ring of rubber or another elastic material.

9. The drive unit according to claim 8, wherein said ring is an arcuate split ring.

10. The drive unit according to claim 8, wherein said ring is defined by at least two segments.

11. The drive unit according to claim 8, wherein said ring is initially tensioned in at least one of a radial and an axial direction in the assembled bearing.

12. The drive unit according to claim 1, wherein said gear unit includes a spur gear connection between said hollow drive shaft and said output shaft of said drive motor; and wherein said output shaft of said drive motor extends parallel to said wheel-set axle.

13. The drive unit according to claim 12, wherein said elastic bearing means is arranged on a side of said hollow drive shaft which is remote from said elastic coupling means.

14. The drive unit according to claim 12, wherein said elastic bearing means is arranged inside said hollow drive shaft.

15. The drive unit according to claim 12, wherein said elastic bearing means is arranged symmetrically with respect to the longitudinal axis of the vehicle and is inside said hollow drive shaft.

16. The drive unit according to claim 12, wherein said drive motor is arranged above said wheel-set axle; and wherein said guide lever means includes at least a pair of substantially horizontally extending steering levers each having one end pivotally coupled to said motor-gearing unit and an other end pivotally coupled to said frame.

17. A drive unit according to claim 12, wherein elastic bearing means including at least one ring of rubber or another elastic material.

18. The drive unit according to claim 17, wherein said ring is an arcuate split ring.

19. The drive unit according to claim 17, wherein said ring is defined by at least two segments.

20. The drive unit according to claim 17, wherein said ring is initially tensioned in at least one of a radial and an axial direction in the assembled bearing.

* * * * *